United States Patent [19]

Grunst

[11] 4,401,867

[45] Aug. 30, 1983

[54] SWITCHING DEVICE WITH FORCED OPENING OF THE CONTACTS

[75] Inventor: Heinz Grunst, Marienheide, Fed. Rep. of Germany

[73] Assignee: Starkstrom Gummersbach GmbH, Marienheide, Fed. Rep. of Germany

[21] Appl. No.: 313,756

[22] Filed: Oct. 22, 1981

[30] Foreign Application Priority Data

Oct. 24, 1980 [EP] European Pat. Off. ..... 80 106511.1

[51] Int. Cl.[3] ..... H01H 21/40; H01H 15/18

[52] U.S. Cl. ..... 200/76; 200/67 R; 200/243; 200/67 PK; 200/DIG. 42

[58] Field of Search ..... 200/67 D, 67 R, 67 PK, 200/76, 243, 245, DIG. 42, 239

[56] References Cited

U.S. PATENT DOCUMENTS 4,216,358 8/1980 Brozille ..... 200/DIG. 42 X 4,347,415 8/1982 Falchi ..... 200/243 X

FOREIGN PATENT DOCUMENTS 2731026 2/1978 Fed. Rep. of Germany ..... 200/67 PK

*Primary Examiner*—Stephen Marcus

*Assistant Examiner*—Ernest G. Cusick

*Attorney, Agent, or Firm*—Michael J. Striker

[57] ABSTRACT

A switch having a housing and within the housing a control plunger formed with a transverse opening through which a contact arm passes transversely to the direction of movement of the plunger; a tension spring urges the contact bridge against the plunger and the free ends of the bridge cooperate with stationary contacts mounted in the housing; another compression spring urges the plunger into its starting position; the free arms of the contact bridge support, respectively, detaching blocks having arresting edges engageable with the plunger in the event when, during the movement of the plunger, the contact arm accidentally sticks to the stationary contacts; the detaching blocks are provided with abutment surfaces cooperating with guiding edges on the inner wall of the housing to disengage the projection from the plunger.

9 Claims, 1 Drawing Figure

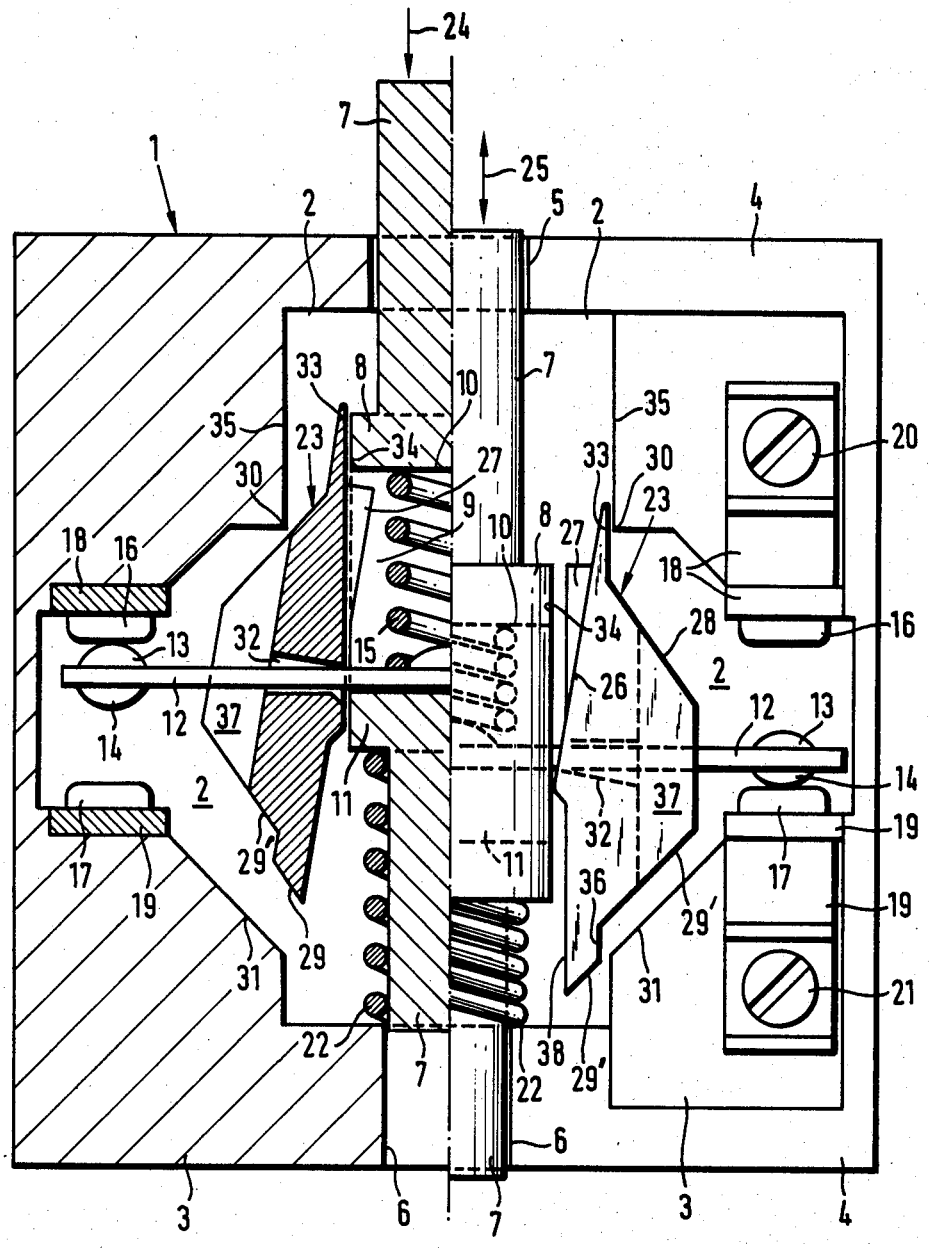
24
7
25
1
2
5
2
4
33
8
10
7
35
35
23
34
27
33
30
20
30
9
10
8
27
23
18
16
18
16
13
32
15
34
28
2
26
12
13
14
12
37
14
2
11
37
32
19
29'
11
17
17
19
36
29'
19
29
31
31
21
22
38
29'
7
22
6
3
6
7
3
4

SWITCHING DEVICE WITH FORCED OPENING OF THE CONTACTS

BACKGROUND OF THE INVENTION

This invention relates in general to switching devices and in particular to a switching device of a type which includes a plunger which is guided for reciprocating movement in a housing, the plunger having at least one recess or opening defining therewith two opposite abutment surfaces and accommodating a first compression spring, and a contact arm arranged in the opening and extending transversely to the direction of movement of the plunger between at least a pair of stationary contacts mounted on the housing.

Switching devices of this kind find application in many switching systems of different construction and in many fields of application. As an example of such known systems, there may be mentioned limit switches which in practice are manufactured in large series. A common feature of these switching devices is a reciprocating plunger which is actuated either manually or mostly mechanically and which serves simultaneously as a support for the contact arm or contact bridge piece. In such switching devices, there can be provided only one contact bridge or several contact bridges arranged side-by-side or one above the other. For the sake of switching reliability, the stroke of the plunger or of the support of the contact bridge must be larger than the path of movement of the contact pieces on the contact bridge. In addition, the contact pressure between the movable and stationary contact pieces cannot correspond to the actuation force applied to the plunger. For these reasons conventional switching devices include a pressure spring which upon actuation of the plunger returns the same into its rest position, where it remains until its reactuation. Another pressure spring is arranged in the recess in the plunger in engagement with the contact bridge. These two springs determine together the contact pressure which is accurately adjustable to a desired value. Each contact bridge, therefore, is loosely supported in the recess of the plunger and is held in position by the resilient force of the pressure spring. This prior-art arrangement, however, has the disadvantage that, during the switching action, an electric arc may occur leading to local overheating at contact points between the movable and stationary contact pieces. This overheating, on the other hand, causes an undesirable adherence or even welding of the contact pieces to each other. It may therefore happen during the actuation of the plunger that one or the other movable contact sticks to the adjoining stationary contact piece and does not open either at all or else only upon the displacement of the contact bridge over a major part of the working stroke when the contact bridge is brought into an oblique position and that the pressure spring is eventually capable of tearing the two adhered or welded contact pieces apart. It is evident that, for these reasons, prior-art switching devices of this kind do not ensure a sufficient operational safety and reliability.

SUMMARY OF THE INVENTION

It is therefore a general object of the present invention to overcome the aforementioned disadvantages.

More particularly, it is an object of the invention to provide an improved switching device which, with the aid of relatively simple means, ensures a substantially increased operational reliability, even in the case when the contacts tend to ahere or weld to each other.

In keeping with these objects and others which will become apparent hereafter, one feature of the invention resides, in a switching device of the aforedescribed type, in the provision of auxiliary detachment means cooperating with the contact bridge in such a manner that a forcible opening of stuck or welded contact pieces takes place immediately upon actuation of the plunger. This enforced opening takes place at a time point at which the non-welded other contacts on the contact bridge are open. One of the substantial advantages of this invention resides in the fact that the forcible opening of contact pieces which may adhere to each other or even become welded to each other is carried out practically without any delay.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE illustrates a sectional top view of the switching device of this invention, the left side being illustrated with the actuation plunger in one of its end positions, namely in its rest position, and the right side showing the plunger in its other end position.

DESCRIPTION OF THE PREFERRED EMBODIMENT

The switching device is shown in the drawing on an enlarged scale, and the actual embodiment is substantially smaller. The switching device includes a housing 1 of a plastic material defining a solid bottom part 3 and an inner space 2 which is so shaped and dimensioned that all movable parts can freely move therein within the range of their working stroke. Housing 1 also includes side walls 4 the top rim of which is covered by a non-illustrated cover plate. Two opposite side walls 4 are formed with guiding openings 5 and 6 for guiding a movable plunger 7 which serves as a support for a contact arm or bridge 12. Preferably the guiding openings 5 and 6 have a rectangular cross section and corresponding cross sections have end parts of the plunger 7 passing through these guiding openings. The central part of plunger 7 has an enlarged cross section and is formed with a rectangular recess or passage 9. The guiding openings 5 and 6 communicate with the upper edges of side walls 4 so that the end parts of the plunger 7 may be introduced into the guiding openings from above. The non-illustrated cover plate acts as an upper holding part for the plunger, and preferably may be formed with downwardly directed guiding ribs for the end parts of the plunger.

The central recess 9 in the longitudinal direction of the plunger defines two bearing surfaces 10 and 11. Bearing surface 11 in the rest position of the plunger 7 supports the contact bridge 12 as shown in the left side of the FIGURE. The opposite bearing surface 10 is in engagement with one end of a compression spring 15 which resiliently presses the contact bridge 12 against the bearing surface 11. In this embodiment, the contact bridge 12 is provided at its end with two opposite contact pieces 13 and 14 which are movable together with the plunger 7. These movable contact pieces cooperate with stationary contact pieces 16 and 17 mounted opposite each other in the housing 1. According to the arrangement of these contacts, the switching device acts as a contact breaker or as a contact closing device. The stationary contact pieces 16 and 17 are connected to terminal bars 18 and 19 embedded in the housing and provided with screws 20 and 21 for the attachment of outer electrical conductors.

Another pressure spring 22 is arranged in the housing around the lower end part of the plunger 7 to bias the same into its rest position. The biasing spring 22 rests on the inner wall of the housing and engages a shoulder of the intermediate part 8 of the plunger 7.

The contact bridge 12 projects from the recess 9 at both sides of the plunger 7 transversely to the direction of its movement. Detaching pieces 23 are mounted on each projecting part of the contact bridge 12 and cooperate with plungers 7 in such a manner that a forcible disengagement of movable contact pieces 13 and 14 from the stationary contact pieces 16 and 17 is effected during the actuation of the plunger 7. In the preferred embodiment of this invention, the detaching pieces are in the form of trapezoidal blocks which are supported on respective projecting parts of the bridge 12. Preferably, each trapezoidal block 23 is formed with an outwardly diverging slot or opening 32 extending approximately at the center of the base of the trapezoid and the free arms of the contact bridge 12 pass through these openings. Due to the diverging cross section of openings 32, each block 23 is tiltable about a small angle relative to the contact bridge 12, as will be seen from a comparison of the rest position of the block 23 (left side) with the actuated position (right side). The cross-sectional area of the diverging slot 32 is dimensioned such that the detaching block 23 can be inserted on the contact bridge 12 over the contact pieces 13 and 14. In practice, these contact pieces are substantially lower than those illustrated in the drawing which, for the sake of clarity, are exaggerated in size. It is of course also possible to attach the contact pieces 13 and 14 to the contact bridge only after the insertion of the detaching blocks 23. The latter method has the advantage that, once the whole subunit consisting of the plunger, contact bridge, contact pressure spring 15, and the detaching blocks 23 is removed from the housing, the whole subunit remains in an assembled condition and its individual component parts cannot be lost. The detaching blocks are made preferably of a hard plastic material of the same sort as the housing 1 and the plunger 7.

The base of each detaching block 23 facing the enlarged intermediate part 8 of the plunger 7 is formed with projections 27 which, in the rest position of the plunger 7, project into the range of the recess 9 and are spaced apart a small distance from the upper bearing surface 10. Preferably, the projection 27 has a wedge-like configuration with an upper stop surface facing the bearing surface 10, which also supports the compression spring 15.

The sloping flanks 28 and 29 of the trapezoidal blocks 23 cooperate with guiding edges 30 and with abutment surfaces 31 formed on the inner walls of housing 1 in such a manner as to displace the projection 27 out of the recess 9 during the actuation of plunger 7.

Each trapezoidal detaching piece 23 is also formed with an upper extension 33 movable between an outer surface portion of the enlarged part 8 of the plunger 7 and an inner wall portion 35 adjoining the guiding edge 30. Each block 23 is also provided with a lower extension 38 forming with a sloping flank 29 on the block a step 36 and being terminated with a sloping surface 29'.

The outer base of the trapezoidal block 23 is with advantage formed with outwardly projecting guiding ribs 37 adjoining opposite narrow sides of the contact bridge 12 so as to prevent any lateral play of the detaching blocks. The flanks of the ribs 37 are in alignment with the flanks 29 of the blocks.

To facilitate the tilting movement of the blocks 23, the larger base of the trapezoid is not straight but has a portion 38 which is parallel with the upper base and a portion 26 forming a sharp angle relative to the upper base so that an edge is formed between the base parts 26 and 38. This edge is always is contact with the outer surface of the enlarged part 8 of the plunger 7 and the blocks 23 performs its tilting movement about this edge. Preferably, the surface part 38 is recessed so that a step adjoining the other base part 26 will result. In the actuated end position of the plunger, illustrated in the right side of the FIGURE, a narrow clearance corresponding to the height of the step is between the base surface 38 and the enlarged part 8 of the plunger.

The operation of the switching device of this invention is as follows:

In an unactuated or rest position of the plunger 7 shown in the left half of the FIGURE, the movable contacts 13 bear on the stationary contacts 16 at a contact pressure which is determined by the biasing spring 22. When the plunger 7 is actuated either manually or by a machine part in the direction of arrow 24, it moves together with the compression spring 15 the contact bridge 12 away from the stationary contacts 16, so that the movable contacts 13 are disengaged from the latter. In the event that one or both movable contacts 13 stick or are arc welded to the stationary contact 16, the projection 27 on the detaching block 23, already after a minute displacement of the plunger 7 is brought into contact with the bearing surface 10 on the plunger, and the detaching block 23, which bridges the compression spring 15 in the recess 9, transmits the pressure from the plunger 7 against the contact bridge 12 so as to forcibly detach the movable contacts 13 from the stationary contacts 16. In this manner, any adhesion or welded spots between the two contacts are forcibly interrupted. As explained initially, due to the fact that the working stroke of the contact bridge 12 is smaller than the path of movement of the plunger 7, upon the breakage of the contact the detaching block 23 cannot remain in its arrested position in engagement with the bearing surface 10 of the plunger (left half of the FIGURE). Instead, upon breakage of the contact, the detaching block 23 is immediately released. This releasing movement is achieved during a further compression of the plunger 7, so that the inclined surface 29 of the projection 38 is brought into engagement with the inclined surface 31 on the inner wall of the housing and slides on the latter until the detaching block is tilted about a small angle which is sufficient to disengage the projection 27 from the recess 9 in the plunger. The movable contacts 14 are now brought into engagement at a contact pressure determined by the compression spring 15 with the other stationary contacts 17, and the plunger is now moved with obstacle to its actuated position. In this actuated position, the detaching block is freely tiltable on the projecting part of the bridge 12 as shown on the right half of the FIGURE. As mentioned before, the tilting movement of the block is limited by the upper extension 33, which abuts against an inner wall portion 35 when the plunger is in its actuated position, whereas the plunger is in its rest position the upper extension rests on the outer surface of the plunger part 34.

As soon as plunger 7 is released, the compressed biasing spring 22 returns the same into its rest position whereby the contact pieces 14 and 17, due to the compression of the spring 15 in the recess 9, remain in engagement until the bearing surface 11 in the recess 9 engages the contact bridge 12 and displaces the same with the movable contacts 14 away from the stationary contacts 17. At the same time, the detaching blocks 23 on the contact bridge 12 are moved into their starting position. In doing so, the upper extension 33 slides along the inner surface 35 of the housing until the stop surfaces of projections 27 are in the range of the recess 9 in the plunger 7 and the sloping flanks 28 of the blocks abut against the guiding edge 30 in the housing so that the blocks 23 are tilted toward the plunger and the projections 27 resume their initial position in the recess 9. Due to the shorter lever arm delimited by the point of engagement of the detaching block 23 on the contact bridge 12 and the contact piece 14, the detaching piece, even during this return movement, exerts sufficient force during its tilting movement as to forcibly break the contact between the contact pieces 14 and 17. If necessary, it is also possible to provide an additional wedge-like projection on the base part 38 of the block which would engage during the return movement the lower edge of the part 8 of the plunger, while during the continuing return movement of the plunger would be disengaged due to the tilting of the block 23. In other words, this modification would ensure the forcible detachment of contact pieces 14 and 17 during the return movement in the direction of arrow 25 in the same manner as during the actuation of the plunger in the direction of arrow 24.

It will be understood that each of the elements described, or two or more together, may also find a useful application in other types of constructions differing from the types described above.

While the invention has been illustrated and described as embodied in a switching device having a single contact bridge, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific asepcts of this invention.

What is claimed as new and desired to be protected by Letters Patent is set forth in the appended claims:

1. A switching device comprising a housing and within the housing a control plunger guided for reciprocating movement; at least one passage formed in a central part of the plunger transversely to the direction of its movement; a contact bridge arranged in said passage and having contact arms projecting at both sides of the plunger; at least one pair of stationary contacts mounted in the housing opposite the projecting arms of said contact bridge; a first tension spring provided in said passage to urge said contact bridge against said plunger; a second spring arranged between said plunger and said housing to bias the plunger in a switching position in which said contact bridge engages said stationary contacts; and detaching means supported on said contact bridge, said detaching means having at least one arresting projection engageable with said plunger when the latter is displaced from its switching position and the contact bridge accidentally adheres to the stationary contacts, and abutment surfaces cooperating with said housing to disengage the detaching means from said plunger when said contact arm has been separated from said stationary contacts.

2. A switching device as defined in claim 1, wherein said detaching means include two blocks of a trapezoidal configuration supported respectively on the free parts of the contact bridge, each block having a larger base facing the plunger and a smaller base adjoining the free end of the assigned part of the contact bridge, said blocks being tiltably supported on the contact bridge and each having a projection engageable with said plunger when said plunger is moved from its contact position and said contact bridge accidentally sticks to said stationary contacts, said blocks further including inclined flanks cooperating with inner walls of said housing to tilt the blocks away from the plunger thus disengaging said projections from said plunger.

3. A switching device as defined in claim 2, wherein each of said projections has a wedge-like configuration defining a stop surface, said projections in one switching position of the plunger projecting into said passage to engage a surface in said passage which supports said first spring.

4. A switching device as defined in claim 3, wherein each detaching block is provided with a slot interconnecting said larger base and said smaller base, for accommodating a part of said contact bridge, and said slot diverging toward said smaller base to permit the tilting movement of said block.

5. A switching device as defined in claim 4, wherein each block further includes a first extension at one end of its larger base, said first extension projecting between an inner wall portion of said housing and the outer surface of said plunger to act as a limit stop for the tilting movement of said detaching block.

6. A switching device as defined in claim 5, further including a second extension at the end opposite the first extension on the larger base of said block, said second extension defining a sloping surface extending parallel to a sloping flank of said block and a step adjoining said sloping flank of the block.

7. A switching device as defined in claim 6, wherein each detaching block includes guiding ribs projecting from said smaller base and each engaging an opposite side of said contact bridge.

8. A switching device as defined in claim 7, wherein the larger base of each block is constituted by two surface portions which are inclined relative to each other to form an edge therebetween, said edge being always in contact with said plunger to act as an axis of tilting of the assigned block.

9. A switching device as defined in claim 8, wherein one of said portions of the larger base is recessed relative to the other surface portion to form a step adjoining said edge.

* * * * *